US008526852B2

(12) United States Patent
Iwasaki

(10) Patent No.: US 8,526,852 B2
(45) Date of Patent: Sep. 3, 2013

(54) ELECTROSTATIC CHARGING APPARATUS, IMAGE FORMING APPARATUS, ELECTROSTATIC CHARGING METHOD AND IMAGE FORMING METHOD

(75) Inventor: Jin Iwasaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 225 days.

(21) Appl. No.: 13/017,722

(22) Filed: Jan. 31, 2011

(65) Prior Publication Data

US 2012/0070192 A1 Mar. 22, 2012

(30) Foreign Application Priority Data

Sep. 17, 2010 (JP) ..... 2010-209268

(51) Int. Cl.
*G03G 21/18* (2006.01)
*G03G 15/02* (2006.01)

(52) U.S. Cl.
USPC ..... 399/115; 399/174

(58) Field of Classification Search
USPC ..... 399/115, 174
See application file for complete search history.

(56) References Cited

FOREIGN PATENT DOCUMENTS

| | | | |
|---|---|---|---|
| JP | A-5-333665 | | 12/1993 |
| JP | 06222650 A | * | 8/1994 |
| JP | A-10-239946 | | 9/1998 |

* cited by examiner

*Primary Examiner* — David Gray
*Assistant Examiner* — Erika J Villaluna
(74) *Attorney, Agent, or Firm* — Oliff & Berridge, PLC

(57) ABSTRACT

An electrostatic charging apparatus includes: an electrostatic charging member that has a discharge face causing discharge between the electrostatic charging member and a to-be-charged member having a charge retention part to hold a charge, and comes in contact with the to-be-charged member so as to charge upon the application of voltage; and an adjusting unit that adjusts an angle between the to-be-charged member and the discharge face.

8 Claims, 13 Drawing Sheets

FIG. 9

| ROTATION NUMBER OF PHOTOCONDUCTOR (X1000 ROTATIONS) | THICKNESS OF PHOTOCONDUCTOR (μm) | ANGLE OF WEDGE-SHAPED REGION | FINE BLACK LINE | UNEVEN POTENTIAL |
|---|---|---|---|---|
| 0～333 | 22～27 | LARGE (θ1) | ○ | ○ |
| 333～666 | 17～22 | MEDIUM (θ2) | ○ | ○ |
| 666～1000 | 12～17 | SMALL (θ3) | ○ | ○ |

FIG. 10

| ROTATION NUMBER OF PHOTOCONDUCTOR (X1000 ROTATIONS) | THICKNESS OF PHOTOCONDUCTOR (μm) | ANGLE OF WEDGE-SHAPED REGION | FINE BLACK LINE | UNEVEN POTENTIAL |
|---|---|---|---|---|
| 0～333 | 22～27 | LARGE (θ1) | ○ | ○ |
| 333～666 | 17～22 | LARGE (θ1) | ○ | △ |
| 666～1000 | 12～17 | LARGE (θ1) | ○ | × |

FIG. 11

| ROTATION NUMBER OF PHOTOCONDUCTOR (X1000 ROTATIONS) | THICKNESS OF PHOTOCONDUCTOR (μm) | ANGLE OF WEDGE-SHAPED REGION | FINE BLACK LINE | UNEVEN POTENTIAL |
|---|---|---|---|---|
| 0～333 | 22～27 | MEDIUM (θ2) | × | ○ |
| 333～666 | 17～22 | MEDIUM (θ2) | ○ | ○ |
| 666～1000 | 12～17 | MEDIUM (θ2) | ○ | △ |

FIG. 12

| ROTATION NUMBER OF PHOTOCONDUCTOR (X1000 ROTATIONS) | THICKNESS OF PHOTOCONDUCTOR (μm) | ANGLE OF WEDGE-SHAPED REGION | FINE BLACK LINE | UNEVEN POTENTIAL |
|---|---|---|---|---|
| 0～333 | 22～27 | SMALL (θ3) | × × | ○ |
| 333～666 | 17～22 | SMALL (θ3) | × | ○ |
| 666～1000 | 12～17 | SMALL (θ3) | ○ | ○ |

ELECTROSTATIC CHARGING APPARATUS, IMAGE FORMING APPARATUS, ELECTROSTATIC CHARGING METHOD AND IMAGE FORMING METHOD

CROSS-REFERENCE TO RELATED APPLICATION

This application is based on and claims priority under 35 USC 119 from Japanese Patent Application No. 2010-209268 filed on Sep. 17, 2010.

BACKGROUND

Technical Field

The present invention relates to an electrostatic charging apparatus, an image forming apparatus, an electrostatic charging method and an image forming method.

SUMMARY

According to an aspect of the invention, there is provided an electrostatic charging apparatus including: an electrostatic charging member that has a discharge face causing discharge between the electrostatic charging member and a to-be-charged member having a charge retention part to hold a charge, and comes in contact with the to-be-charged member so as to charge upon the application of voltage; and an adjusting unit that adjusts an angle between the to-be-charged member and the discharge face.

BRIEF DESCRIPTION OF THE DRAWINGS

Exemplary embodiment(s) of the present invention will be described in detail based on the following drawings, wherein:

FIG. 4A is a view illustrating the electrostatic charging member being positioned in a first position; FIG. 4B is a view illustrating the electrostatic charging member being positioned in a second position; and FIG. 4C is a view illustrating the electrostatic charging member being positioned in a third position;

FIG. 7A is a view in the state that discharge is stable, and FIG. 7B is a view in the state that discharge is unstable;

FIG. 8A is a view explaining about a process that the photoconductor is electrostatically charged in a case of a thick charge retention part in the photoconductor; and FIG. 8B is a view explaining about a process that the photoconductor is electrostatically charged in a case of a thin charge retention part in the photoconductor;

FIG. 9 is a diagram illustrating the occurrence of a fine black line and an uneven potential on the images formed corresponding to the number of image formations and the number of rotations of the photoconductor when the electrostatic charging apparatus shown in FIG. 2 charges the photoconductor;

FIG. 10 is a diagram illustrating the occurrence of a fine black line and an uneven potential on the images formed corresponding to the number of image formations and the number of rotations of the photoconductor when the electrostatic charging apparatus according to a first comparative example charges the photoconductor;

FIG. 11 is a diagram illustrating the occurrence of a fine black line and an uneven potential on the images formed corresponding to the number of image formations and the number of rotations of the photoconductor when the electrostatic charging apparatus according to a second comparative example charges the photoconductor;

FIG. 12 is a diagram illustrating the occurrence of a fine black line and an uneven potential on the images formed corresponding to the number of image formations and the number of rotations of the photoconductor when the electrostatic charging apparatus according to a third comparative example charges the photoconductor;

FIG. 14A is a view of the electrostatic charging member being in a first position; FIG. 14B is a view of the electrostatic charging member being in a second position; and FIG. 14C is a view of the electrostatic charging member being in a third position;

FIG. 16A is a view of the electrostatic charging member being in a first position; FIG. 16B is a view of the electrostatic charging member being in a second position; and FIG. 16C is a view of the electrostatic charging member being in a third position.

DETAILED DESCRIPTION

Next, an exemplary embodiment of the present invention will be described based on the drawings.

Figure 1:
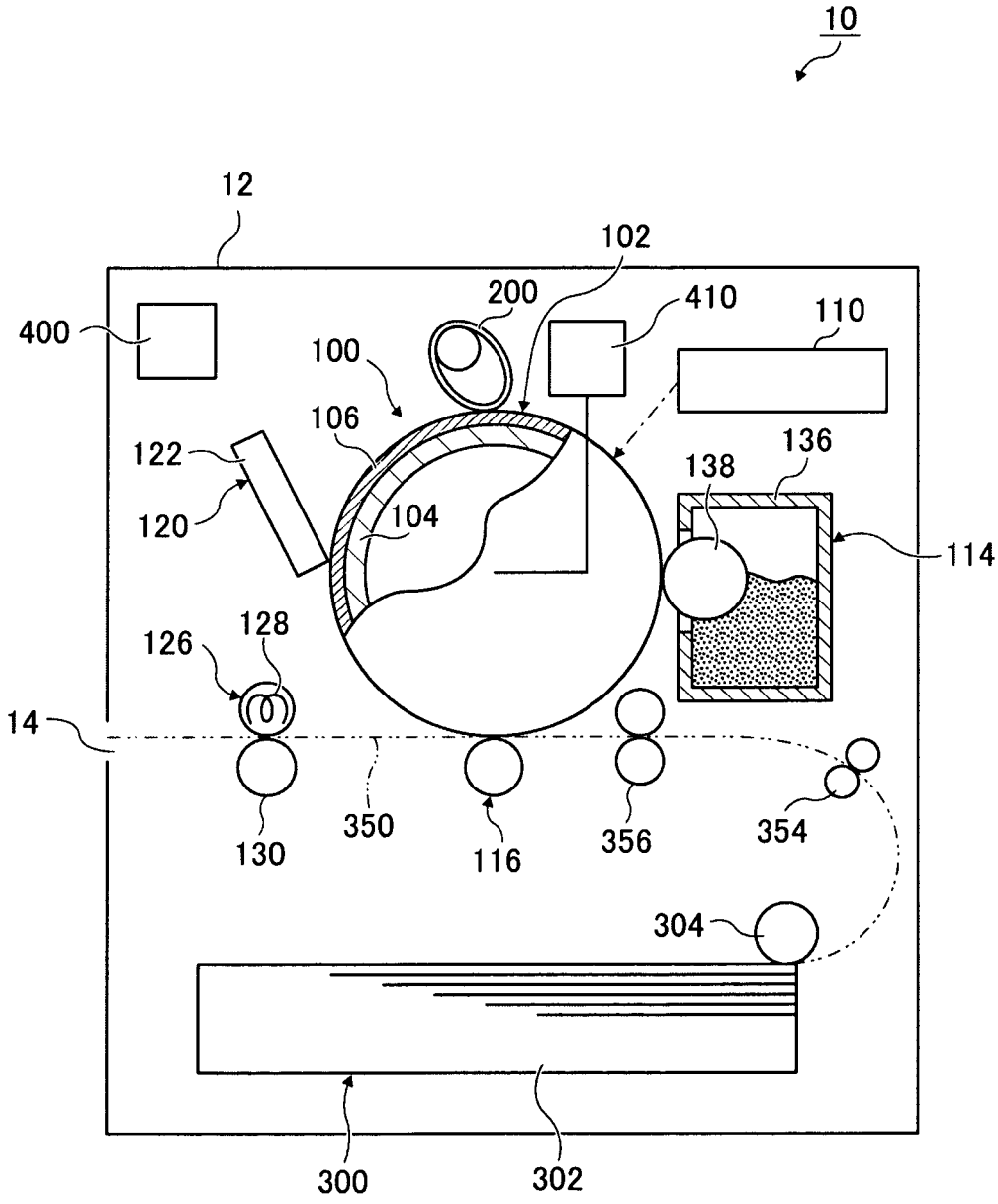
FIG. 1 is a view illustrating an image forming apparatus according to a first exemplary embodiment of the present invention.

FIG. 1 illustrates an image forming apparatus 10 according to a first exemplary embodiment of the present invention. As shown in FIG. 1, the image forming apparatus 10 has an image forming apparatus main body 12, and the image forming apparatus main body 12 has an image forming unit 100, a paper feeder 300, and a controller 400 serving as a control unit therein. The image forming apparatus main body 12 further has a transport path 350 through which a paper as a recording medium is delivered. Additionally, the image forming apparatus 12 has an exit 14 for ejecting a paper.

The image forming unit 100 is used to form an image having e.g. a single color and employs electro-photography. The image forming unit 100 has a photoconductor 102, an electrostatic charging apparatus 200 which charges the photoconductor 102, a latent image forming device 110 which emits light on the surface of the photoconductor 102 charged by the electrostatic charging apparatus 200 so as to form an electrostatic latent image on the surface of the photoconductor 102, a developing device 114 which develops the latent image formed on the photoconductor 102 with a developer so as to form a developer image on the surface of the photoconductor 102, a transfer device 116 which transfers the developer image formed on the surface of the photoconductor 102 by the developing device 114 onto a paper, a cleaning device 120 which cleans up the photoconductor 102 after the transferring of the developer image onto the paper by the transfer device 116, and a fixing device 126 which allows the developer image transformed onto the paper by the transfer device 116 to be fixed on the paper.

The photoconductor 102 is e.g. cylindrical, and is employed as a to-be-charged member as well as an image carrier. Further the photoconductor 102 has a base 104 which is made of e.g. aluminum and is e.g. cylindrical. The base 104 is covered with a film 106 on the surface thereof. The film 106 is employed as a charge retention part to hold a charge, consists of e.g. an organic photosensitive layer, and for example, includes a charge generation layer having a charge generation material used for generating a charge and a resin as a binder and a charge transport layer having a charge transport material used for transporting a charge and a resin as a binder. Additionally a under coat layer, a protective layer and the like may be provided. Further, a rotation counter 410 to count the number of rotations of the photoconductor 102 is arranged in the photoconductor 102.

The developing device 114 has a developing device main body 136, and the developing device main body 136 has a developer carrying member 138 being e.g. cylindrical. The developing device main body 136 further accommodates developer consisting of toner and carrier therein. The toner of the developer is carried toward the photoconductor 102 by the developer carrying member 138.

The cleaning device 120 has a cleaning member 122, whose the one end presses the photoconductor 102 to remove e.g. a toner from the surface of the photoconductor 102, for cleaning up the photoconductor 102. Due to the pressing force by the cleaning member 122, the film 106 of the photoconductor 102 is subjected to abrasion, thus becoming thinner, as the number of rotations of the photoconductor 102 or the number of formed images by the photoconductor 102 increases. In addition, the film 106 is also subjected to abrasion by contact with the developer carrying member 138, the transfer device 116 and the electrostatic charging apparatus 200.

The fixing device 126 has a heating roller 128 having internally a heat source and a pressure roller 130 being in connect with the heating roller 128. The transferred toner image on a paper is fixed by heated and pressurized at the contact region between the heating roller 128 and the pressure roller 130.

The paper feeder 300 feeds the image forming unit 100 with a paper. The paper feeder 300 has a paper container 302 in which papers are stacked and a feed roller 304 to forward papers from the paper container 302.

The transport path 350 is defined as a transport path through which a paper is fed to the paper feeder 300, the transfer device 116, the fixing device 126, and subsequently the exit 14 for ejecting from the image forming apparatus main body 12. Along the transport path 350, the above feed roller 304, a conveyance roller 354, a registration roller 356, the above transfer device 116, and the above fixing device 126 are arranged sequentially from the upstream in the paper transporting direction.

The registration roller 356 temporarily stops the movement of a paper toward the transfer device 116 at the top of a paper, and subsequently releases the movement of the paper toward the transfer device 116 in the stopping state at the top of a paper so as to adapt to the timing where a developer image is formed onto the photoconductor 102.

Figure 2:
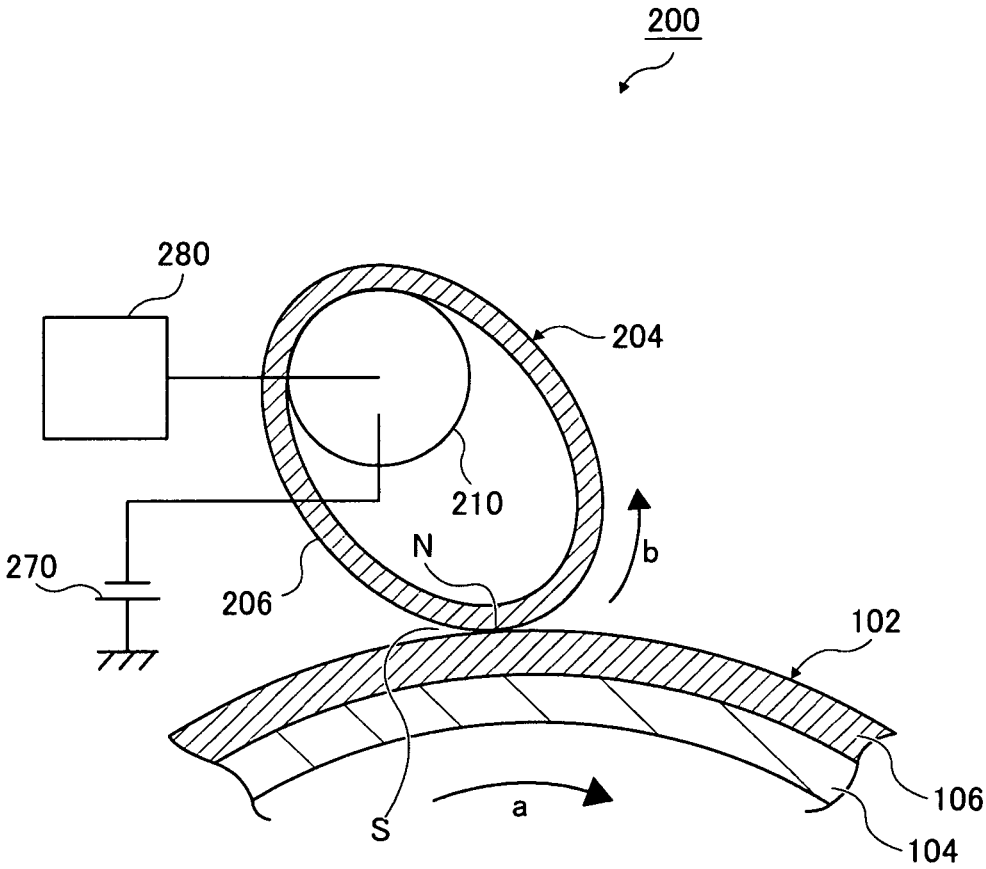
FIG. 2 is a view illustrating an electrostatic charging apparatus provided in the image forming apparatus of FIG. 1.

FIG. 2 illustrates the electrostatic charging apparatus 200. As shown in FIG. 2, the electrostatic charging apparatus 200 has an electrostatic charging member 204 and a support 210 supporting the electrostatic charging member 204. The electrostatic charging member 204 is employed as a charging electrode to charge the photoconductor 102. Additionally, the electrostatic charging member 204 has an outer periphery 206 employed as a discharge face causing discharge around the photoconductor 102, and is employed as an electrostatic charging member which comes in contact with the photoconductor 102 to be charged after the application of voltage. The electrostatic charging member 204 is flexible, endless-shaped, cylindrical, and semi-conductive film-shaped or rubber-like.

The support 210 being conductive, and e.g. cylindrical, has a smaller outer diameter than the inner diameter of the electrostatic charging member 204, and thus is arranged inside the electrostatic charging member 204. An adjusting mechanism 280 served as an adjusting unit which adjusts an angle θ between the photoconductor 102 and the outer periphery 206 of the electrostatic charging member 204 is attached to the support 210. Additionally, a voltage application device 270 is attached to the support 210. The angle θ will be described later.

The electrostatic charging member 204 is in contact with the photoconductor 102 in a contact position N in the electrostatic charging apparatus 200. The electrostatic charging member 204 is subjected to a voltage by the voltage application device 270 via the support 210. During the application of voltage, the electrostatic charging member 204 sticks fast to the photoconductor 204 due to static electricity. The electrostatic charging member 204 thus rotates in the direction of the arrow b in conjunction with the rotation of the photoconductor 102 in the direction of the arrow a.

Further, in the electrostatic charging apparatus 200, there is a wedge-shaped region S which is formed in a position of the upstream side of the contact position N in the direction of rotation of the photoconductor 102 and between the outer periphery 206 of the electrostatic charging member 204 and the photoconductor 102. Upon the application of voltage to the electrostatic charging member 204 by the voltage application device 270, an electrical discharge occurs in the region S and thereby the film 106 of the photoconductor 102 is charged.

Figure 3:
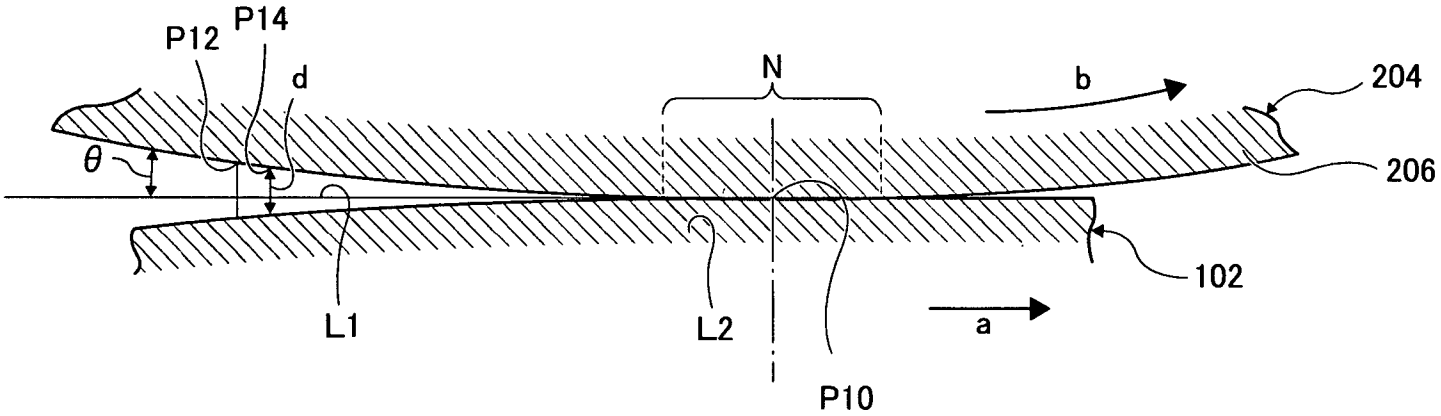
FIG. 3 is a view explaining about an angle θ between an outer periphery of the electrostatic charging member in the electrostatic charging apparatus and a photoconductor.

FIG. 3 is a cross-sectional view illustrating enlarged the neighborhood of the contact position N and explaining the angle θ between the outer periphery 206 of the electrostatic charging member 204 and the photoconductor 102. The angle θ indicates an angle between the photoconductor 102 and the outer periphery 206 of the electrostatic charging member 204 in the neighborhood of the contact position N of the region S, specifically the angle being the upstream side of the contact position N in the direction of the movement of the photoconductor 102. More specifically, the angle θ indicates an average angle between individual tangent line L2 of the outer periphery 206 to a tangent point between the point P10 and the point P12 and a tangent line L1. Note that, the point P10 is the central point in the width of the contact position N in the direction of the movement of the photoconductor 102; the tangent line L1 is a tangent line of the photoconductor 102 to the point P10; and the point P12 is another end opposite to the point P10 in the region S where discharge occurs around the outer periphery 206 of the electrostatic charging member 204. The region. S includes a unstable discharge region as well as a stable discharge region.

The size of the angle θ may be determined by a distance d between the photoconductor 102 and the outer periphery 206 of the electrostatic charging member 204 at a point P14 located at a given distance from the point P10 on the tangent line L1 in the direction of the movement of the photoconductor 102 is positioned within the region S. For example, the size of the angle θ can determined by the distance d between the photoconductor 102 and the outer periphery 206 of the electrostatic charging member 204 at a point located 800 μm away from the point P10 on the tangent line L1 upstream in the direction of the movement of the photoconductor 102.

Figure 4A:
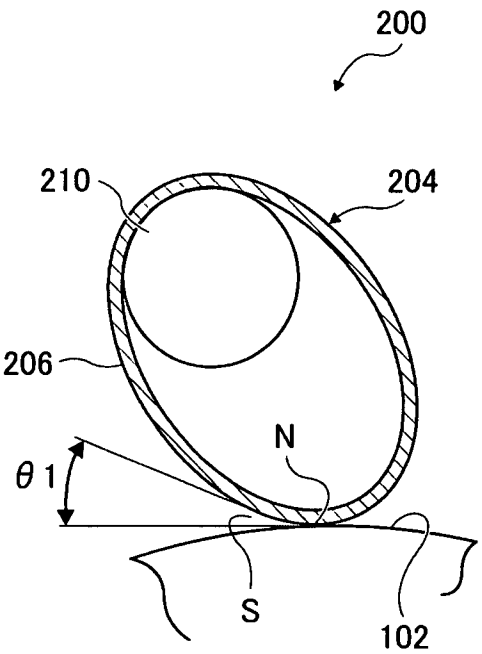
FIGS. 4A, 4B and 4C are views illustrating the electrostatic charging apparatuses shown in FIG. 2.
Figure 4B:
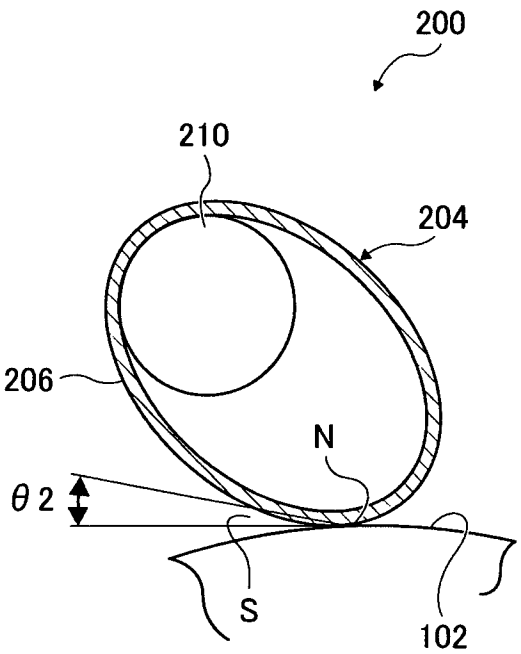
Figure 4C:
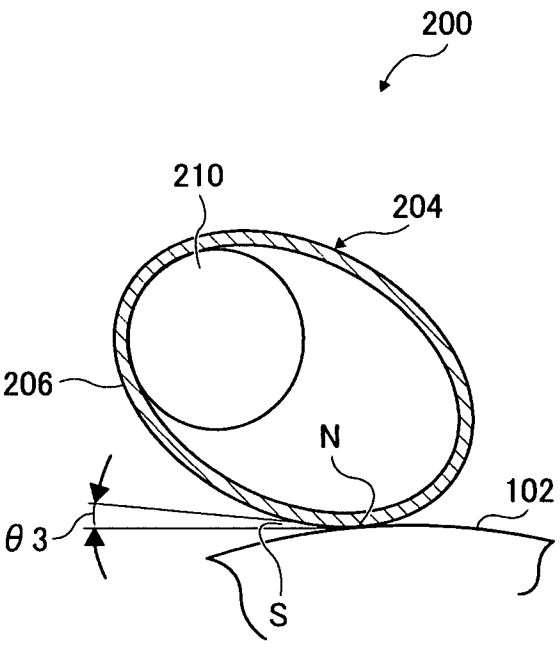

FIG. 4 illustrates the operation of the electrostatic charging apparatus 200. As shown in FIG. 4, the support 210 of the electrostatic charging apparatus 200 is arranged so as to move between positions shown in FIGS. 4A, FIG. 4B, and FIG. 4C using the adjusting mechanism 280 (Refer to FIG. 2). The electrostatic charging member 204 moves between positions shown in FIGS. 4A, FIG. 4B, and FIG. 4C corresponding to the movement of the support 210. The positions of the support 210 and the electrostatic charging member 204 shown in FIG. 4A, FIGS. 4B, and FIG. 4C will be referred to as a first position, a second position, a third position, respectively below.

As the support 210 and the electrostatic charging member 204 move, the angle θ varies. When the support 210 and the electrostatic charging member 204 are in the first position, the angle θ is θ1; when the support 210 and the electrostatic charging member 204 are in the second position, the angle θ is θ2; and when the support 210 and the electrostatic charging member 204 are in the third position, the angle θ is θ3. In the case, θ1 is greater than θ2, and θ2 is greater than θ3.

In the point located upstream 800 μm away from the contact position N in the direction of the movement of the photoconductor 102, when the angle θ is θ1, the distance between the photoconductor 102 and the outer periphery 206 is 120 μm; when the angle θ is θ2, the distance between the photoconductor 102 and the outer periphery 206 is 80 μm; and when the angle θ is θ3, the distance between the photoconductor 102 and the outer periphery 206 is 40 μm.

The adjusting mechanism 280 (Refer to FIG. 2) is controlled by the controller 400 (Refer to FIG. 1) in the image forming apparatus 10. After the completion of a series of operations for forming an image, the support 210 and the electrostatic charging member 204 move so as to be in the states of the first position. Therefore, when an operation for forming an image starts, the support 210 and the electrostatic charging member 204 are located in the first position and the angle θ is θ1.

Figure 5:
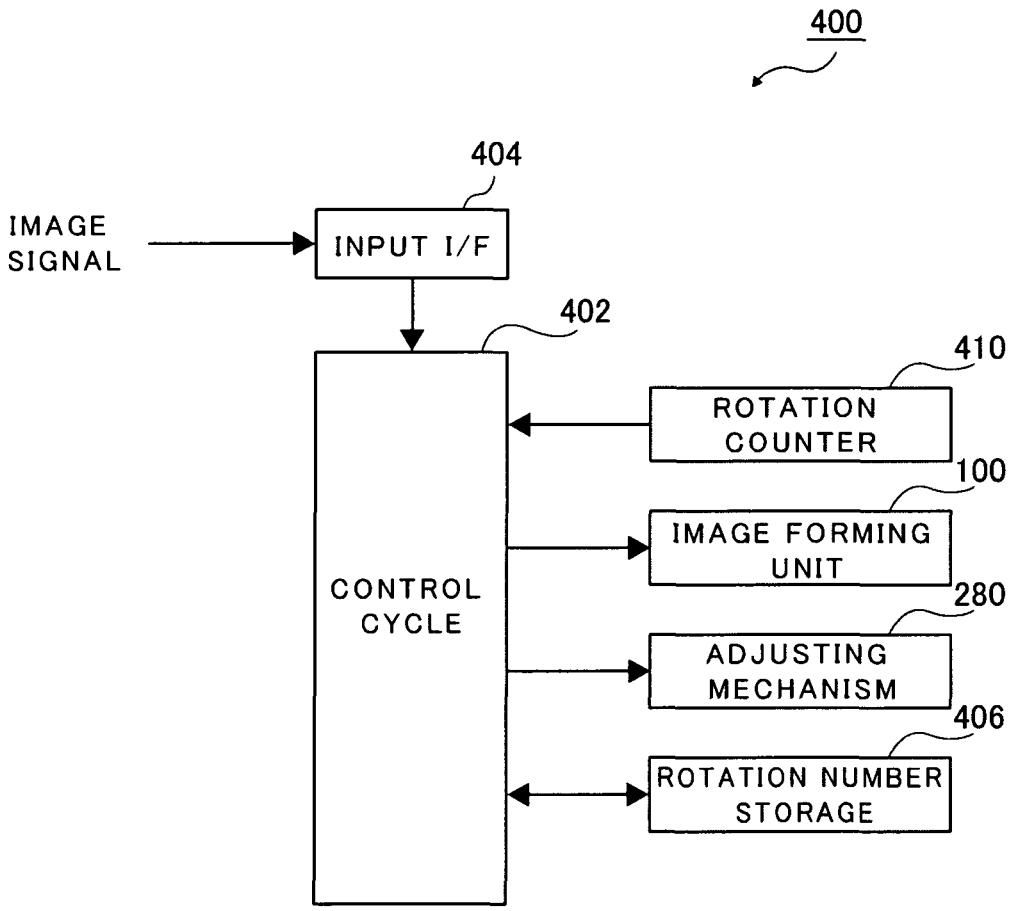
FIG. 5 is a block diagram of a control in the image forming apparatus shown in FIG. 1.

FIG. 5 illustrates the controller 400. The controller 400 is employed as a control unit which controls the adjusting mechanism 280 to allow the angle θ to be small in response to increasing the number of charging of the electrostatic charging apparatus 200 and increasing the number of image formations by the image forming unit 100. As shown in FIG. 5, the controller 400 also has a control circuit 402 to which image signal is input via a communication interface 404 and an output signal is input from a rotation counter 410. The control circuit 402 is connected to a rotation number storage 406 storing data for the number of rotations of the photoconductor 102. The image forming unit 100 and the adjusting mechanism 280 are controlled by output of signal from the control circuit 402.

Figure 6:
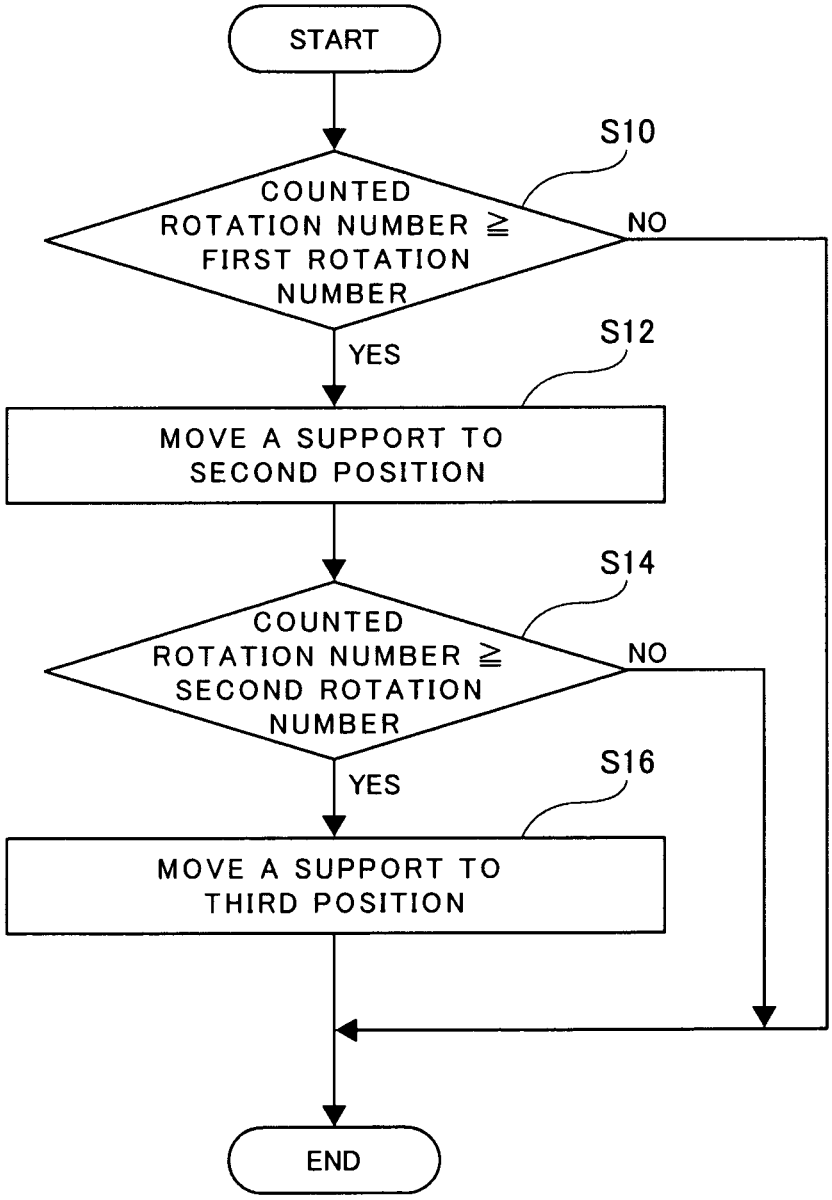
FIG. 6 is a flow-chart explaining about the operations of the image forming apparatus shown in FIG. 1.

FIG. 6 illustrates the operation of the image forming apparatus 10, i.e. the control of the adjusting mechanism 280 using the controller 400. As shown in FIG. 6, on starting a series of controls by inputting image signal by the communication interface 404, the controller 400 discriminates whether or not the number of rotations of the photoconductor 102 since the attachment of the photoconductor 102 onto the image forming apparatus main body 12 is equal to or more than predetermined times i.e. a first number of rotations N1 in the step S10. If the number of rotations of the photoconductor 102 is less than the first number of rotations N1, the controller 400 terminates a series of controls. If the number of rotations of the photoconductor 102 is equal to or more than the first number of rotations N1, the operation proceeds to the next step S12.

The predetermined first number of rotations N1 is e.g. 333K rotations, and the term K is X1000. The first number of rotations N1 is determined in consideration of influence on abrasion of the film 106 caused by the rotation of the photoconductor 102, and the abrasion of the film 106 is dependent on factors such as hardness of the film 106, hardness of the cleaning member 122 in the cleaning device 120, and a pressing force of the cleaning member 122 against the photoconductor 102. For example, the number of rotations N1 of the photoconductor 102 is determined so as to be the number of rotations that the thickness of the film 106 reduces from 27 μm i.e. starting thickness to 22 μm.

In the step S12, the controller 400 controls the adjusting mechanism 280 so as to move the electrostatic charging member 204 and the support 210 to the second position (Refer to FIG. 4B). Therefore, the angle θ between the photoconductor 102 and the outer periphery 206 of the electrostatic charging member 204 reduces from θ1 to θ2.

In the next step S14, the controller 400 discriminates whether or not the number of rotations of the photoconductor 102 since the attachment of the photoconductor 102 onto the image forming apparatus main body 12 is equal to or more than predetermined times i.e. a second number of rotations N2. If the number of rotations of the photoconductor 102 is less than the second number of rotations N2, the controller 400 terminates a series of controls. If the number of rotations of the photoconductor 102 is equal to or more than the second number of rotations N2, the operation proceeds to the next step S16.

The predetermined second number of rotations N2 is e.g. 666K rotations, and the term K is X1000. The second number of rotations N2 is determined in consideration of influence on abrasion of the film 106 caused by the rotation of the photoconductor 102 as well as the first number of rotations of N1, and the abrasion of the film 106 is dependent on a factor such as hardness of the film 106, hardness of the cleaning member 122 in the cleaning device 120, and a pressing force of the cleaning member 122 against the photoconductor 102. For example, the second number of rotations N2 of the photoconductor 102 is determined so as to be the number of rotations that the thickness of the film 106 reduces to 17 μm.

In the step S16, the controller 400 controls the adjusting mechanism 280 so as to move the electrostatic charging member 204 and the support 210 to the third position (Refer to FIG. 4C) Therefore, the angle θ between the photoconductor 102 and the outer periphery 206 of the electrostatic charging member 204 reduces from θ2 to θ3.

As described above, the image forming apparatus 10 is configured so that the angle between the photoconductor 102 and the outer periphery 206 of the electrostatic charging member 204 varies in response to increasing the number of charging and increasing the number of image formations, and the angle θ between the photoconductor 102 and the outer periphery 206 of the electrostatic charging member 204 becomes smaller in response to increasing the number of charging and increasing the number of image formations.

Additionally, the image forming apparatus 10 is configured so that the angle between the photoconductor 102 and the outer periphery 206 of the electrostatic charging member 204 varies in response to variation of the thickness of the film 106 in the photoconductor 102. Further, in the image forming apparatus 10, the angle θ between the photoconductor 102 and the outer periphery 206 of the electrostatic charging member 204 becomes smaller in response to reducing the thickness of the film 106 in the photoconductor 102.

Figure 7A:
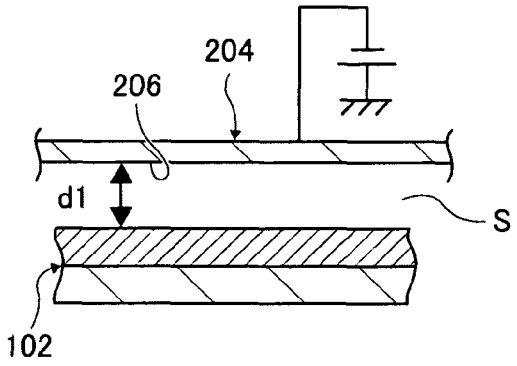
FIGS. 7A and 7B are views explaining about discharge occurred between the electrostatic charging member provided in the electrostatic charging apparatus and the photoconductor in FIG. 2.
Figure 7B:
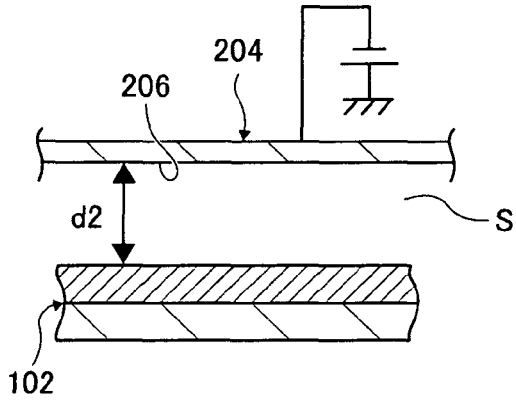

FIGS. 7A and 7B explain discharge occurred between the electrostatic charging member 204 and the photoconductor 102. FIG. 7A cross-sectionally illustrates discharge in the case that the distance d between the photoconductor 102 and the outer periphery 206 of the electrostatic charging member 204 is d1 in the region S, and FIG. 7B cross-sectionally illustrates the same in the case that the distance d is d2 in the region S. As shown in FIGS. 7A and 7B, d2 is longer than d1.

When the distance d is less than d1, discharge occurs stably between the photoconductor 102 and the electrostatic charging member 204 in the image forming apparatus 10. When the distance d is equal to or more than d1 and is less than d2, discharge occurs unstably between the photoconductor 102 and the electrostatic charging member 204. Further, when the distance d is equal to or more than d2, discharge does not occur between the photoconductor 102 and the electrostatic charging member 204.

A region that the distance d is less than d1 in the wedge-shaped region S (Refer to FIG. 2 also) and discharge occurs stably between the photoconductor 102 and the electrostatic charging member 204 will be referred to as a stable discharge region below. Further, a region that the distance d is equal to or more than d1 and less than d2 in the wedge-shaped region S and discharge occurs unstably between the photoconductor 102 and the electrostatic charging member 204 will be referred to as an unstable discharge region below.

Figure 8A:
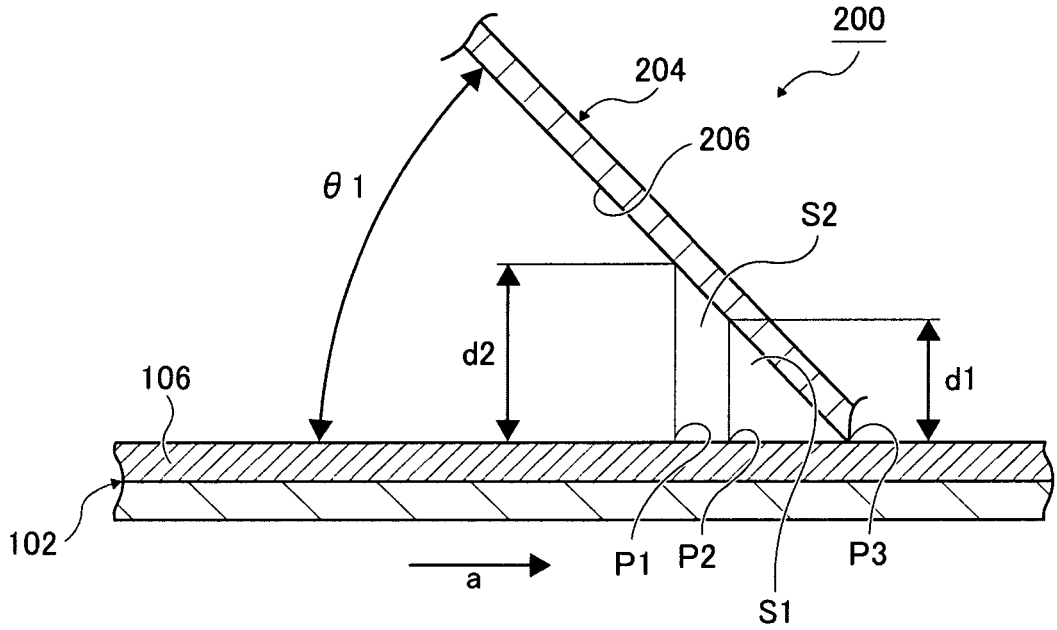
FIGS. 8A and 8B are views explaining about processes for electrostatic charging to the photoconductor with the electrostatic charging apparatus shown in FIG. 2.
Figure 8B:
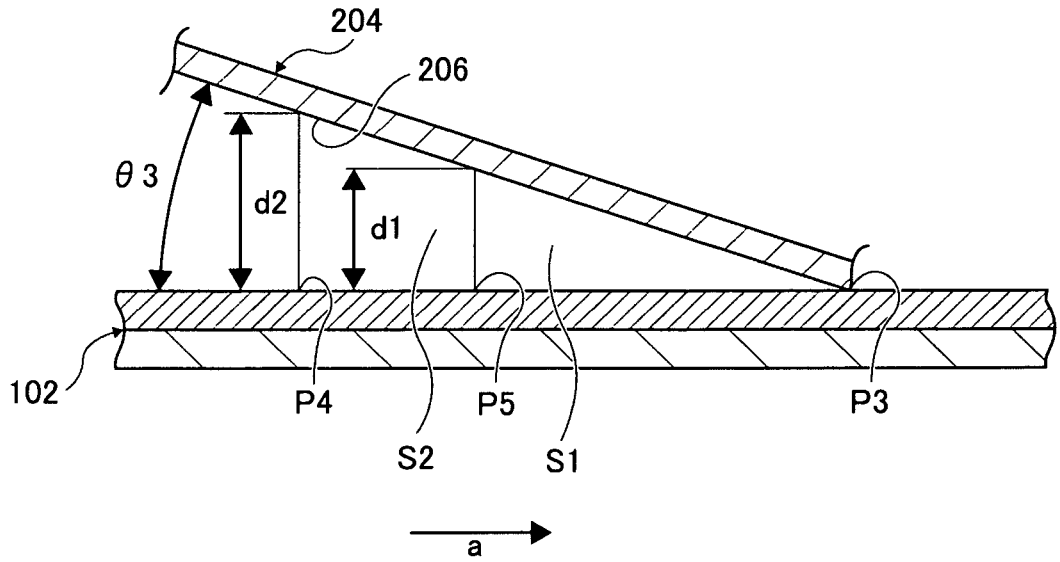

FIGS. 8A and 8B explain processes that the electrostatic charging apparatus 200 charges the photoconductor 102. FIG. 8A illustrates the step of the electrostatic charging on the photoconductor 102 in the case that the photoconductor 102 has the thickness of the film 106 being equal to or more than 22 μm and the electrostatic charging member 204 and the support 210 are located in the first position (Refer to FIG. 4A). FIG. 8B illustrates the step of the electrostatic charging on the photoconductor 102 in the case that the photoconductor 102 has the thickness of the film 106 being equal to or less than 17 μm and thereby the electrostatic charging member 204 and the support 210 move to the third position (Refer to FIG. 4C). In FIGS. 8A and 8B, for convenience of illustration, the curved surfaces of the photoconductor 102 and the outer periphery 206 of the electrostatic charging member 204 are illustrated as a plane respectively. The arrow a in FIGS. 8A and 8B illustrates the direction of the movement of the photoconductor 102.

In FIGS. 8A and 8B, a region S1 that the distance d between the photoconductor 102 and the outer periphery 206 of the electrostatic charging member 204 is less than d1 is a stable discharge region, and a region S2 that the distance d is equal to or more than d1 and is less than d2 is an unstable discharge region. A region that the distance d is equal to or more than d2 is no discharge region. The region S1 will be referred to as a stable discharge region S1, and the region S2 will be referred to as an unstable discharge region S2 below.

As shown in FIG. 8A, when the electrostatic charging member 204 is located in the first position, a certain portion of the photoconductor 102 passes through points P1 and P2 and subsequently comes at a point P3 during the movement of the photoconductor 102 along the direction of the arrow a. Therefore the certain portion of the photoconductor 102 passes through the unstable discharge region S2 during passing from the point P1 to the point P2, and passes through the stable discharge region S1 during passing from the point P2 to the point P3. Consequently, the certain portion of the photoconductor 102 is electrostatically charged by passing through the unstable discharge region S2 and the stable discharge region S1 and thus being subjected to discharge occurred between the photoconductor 102 and the electrostatic charging member 204.

Further as shown in FIG. 8B, when the electrostatic charging member 204 is located in the second position, a certain portion of the photoconductor 102 passes through points P4 and P5 and subsequently comes at the point P3 during the movement of the photoconductor 102 along the direction of the arrow a. Therefore the certain portion of the photoconductor 102 passes through the unstable discharge region S2 during passing from the point P4 to the point P5, and passes through the stable discharge region S1 during passing from the point P5 to the point P3. Consequently, the certain portion of the photoconductor 102 is electrostatically charged by passing through the unstable discharge region S2 and the stable discharge region S1 and thus being subjected to discharge occurred between the photoconductor 102 and the electrostatic charging member 204.

FIG. 9 is a diagram illustrating the observations of images formed in the image forming apparatus 10 for occurrence of a fine black line and occurrence of an uneven potential when the electrostatic charging apparatus 200 of the image forming apparatus 10 according to the first exemplary embodiment of the present invention charges the photoconductor 102. The observations describes the formed image in each the number of rotations since starting use of the photoconductor 102 attached to the image forming apparatus main body 12. The first column of the diagram in FIG. 9 indicates the number of rotations of the photoconductor 102 since starting use of the photoconductor 102. The second column of the diagram in FIG. 9 indicates the thickness of the film 106. The third column of the diagram in FIG. 9 indicates the angle between the photoconductor 102 and the electrostatic charging member 204 in the wedge-shaped region S (Refer to FIG. 4). The fourth column of the diagram in FIG. 9 indicates whether or not a fine black line occurs on the formed image, and a circle in the fourth column means that a fine black line does not occur, that is, there is no problem on image quality. The fifth column of the diagram in FIG. 9 indicates the degree of the uneven potential occurring on the photoconductor 102 by electrostatic charging the photoconductor 102, and a circle in the fifth column means that the degree of the uneven potential on the photoconductor 102 is less than 10 V, that is, there is no problem on image quality in the formed image. An uneven potential causes uneven density in the formed image on the photoconductor 102.

As shown in FIG. 9, in the image forming apparatus 10 according to the first exemplary embodiment, when the number of rotations of the photoconductor 102 is up to 333K rotations, a fine black line does not occur. The angle θ is θ1 during electrostatic charging the photoconductor 102 (Refer to FIG. 8A), and thus a certain portion of the photoconductor 102 has shorter time to pass through the unstable discharge region S2 as compared with the case with the angle θ3 (Refer to FIG. 8B).

Further in the image forming apparatus 10 according to the first exemplary embodiment, when the number of rotations of the photoconductor 102 is up to 333K rotations, an uneven potential does not significantly affect image quality. The angle θ is θ1 during electrostatic charging the photoconductor 102, and thus though a certain portion of the photoconductor 102 has shorter time to pass through the stable discharge region S1 as compared with the case with the angle θ3, the film 106 is subjected to the electrostatic charging by the application of relatively-low charge because of a relatively-thick film.

Further in the image forming apparatus 10 according to the first exemplary embodiment, when the number of rotations of the photoconductor 102 is between 333K to 666K rotations, a fine black line does not occur and an uneven potential does not significantly affect image quality.

Further in the image forming apparatus 10 according to the first exemplary embodiment, when the number of rotations of the photoconductor 102 is between 666K and 1000K rotations, a fine black line does not occur. The angle θ is θ3 during electrostatic charging onto the photoconductor 102 (Refer to FIG. 8B), and thus a certain portion of the photoconductor 102 has longer time to pass through the unstable discharge region S2 as compared with the case with the angle θ1. However, since having a relatively-thin film, the film 106 needs a large amount of electric charge in order to be subjected to electrostatic charging as well as the case with a thick film, and consequently a fine black line little occurs.

FIG. 10 is a diagram illustrating the observations of images formed in an image forming apparatus 10 according to a first comparative example for occurrence of a fine black line and occurrence of an uneven potential as the electrostatic charging apparatus 200 of the image forming apparatus 10 charges to the photoconductor 102. The observations describe the formed image in each the number of rotations since starting use of the photoconductor 102. In the contrast to the change of the angle θ in response to the number of rotations of the photoconductor 102 in the above image forming apparatus 10 according to the first exemplary embodiment, the image forming apparatus 10 according to the first comparative example keeps the angle θ at θ1 (Refer to FIG. 8A) regardless of the number of rotations of the photoconductor 102. The image forming apparatus 10 according to the first comparative example has same configuration as the image forming apparatus 10 according to the first exemplary embodiment except that the angle remains at θ1.

Items in the first to fifth columns of FIG. 10 are the same as FIG. 9, respectively. Further, an open triangle in the fifth column means that the uneven potential on the photoconductor 102 ranges from 10 V to 20 V, and the formed images has acceptable uneven density for image quality. Furthermore, a cross in the fifth column means that the uneven potential on the photoconductor 102 ranges from 20 V to 30 V, and the range is problematic with uneven density of the formed images for image quality.

In the image forming apparatus 10 according to the first comparative example, when the number of rotations of the photoconductor 102 is between 333K and 666K rotations, an uneven potential occurs on the photoconductor 102 and thus the formed image has uneven density with acceptable image quality. Since the angle θ remains at θ1 (Refer to FIGS. 8A and 4A) during electrostatic charging the photoconductor 102, a certain portion of the photoconductor 102 has shorter time to pass through the stable discharge region S1 as compared with the case of θ2. Further, the film 106 has a thickness between 17 μm and 22 μm i.e. a medium thickness, and thus is not subjected to enough electric charge to be subjected stable electrostatic charging.

Further in the image forming apparatus 10 according to the first comparative example, when the number of rotations of the photoconductor 102 is between 666K and 1000K rotations, an uneven potential occurs on the photoconductor 102 and the formed image has a problematic uneven density with image quality. Since the angle θ remains at θ1 (Refer to FIG. 8A) during electrostatic charging on the photoconductor 102, a certain portion of the photoconductor 102 has shorter time to pass through the stable discharge region S1 as compared with the case of θ3 (Refer to FIG. 8B). Further, the film 106 has a thickness between 12 μm and 17 μm i.e. relatively-thin, and thus is not subjected to enough electric charge to be subjected stable electrostatic charging.

FIG. 11 is a diagram illustrating the observations of images formed in an image forming apparatus 10 according to a second comparative example for occurrence of a fine black line and occurrence of an uneven potential as the electrostatic charging apparatus 200 of the image forming apparatus 10 charges the photoconductor 102. The observations describe the formed image in each the number of rotations since starting use of the photoconductor 102. In the contrast to the change of the angle θ in response to the number of rotations of the photoconductor 102 in the above image forming apparatus 10 according to the first exemplary embodiment, the image forming apparatus 10 according to the second comparative example keeps the angle θ at θ2 (Refer to FIG. 43) regardless of the number of rotations of the photoconductor 102. The image forming apparatus 10 according to the second comparative example has same configuration as the image forming apparatus 10 according to the first exemplary embodiment except that the angle remains at θ2.

Items in the first to fifth columns of FIG. 11 are the same as FIG. 9, respectively. Further, a cross in the fourth column illustrating whether or not a fine black line occurs on a formed image means that a fine black line occurs on the image and the degree of a fine black line is problematic for image quality. Furthermore, an open triangle in the fifth column means that the uneven potential on the photoconductor 102 ranges from 10 V to 20 V, and the formed image has acceptable uneven density for image quality, as well as FIG. 10.

In the image forming apparatus 10 according to the second comparative example, when the number of rotations of the photoconductor 102 is up to 333K rotations, a fine black line occurs on an image and the degree of a fine black line is within a problem of an image quality. Since the angle θ remains at (Refer to FIG. 4B) during electrostatic charging the photoconductor 102, a certain portion of the photoconductor 102 has longer time to pass through the unstable discharge region S2 as compared with the case of θ1 (Refer to FIGS. 4A and 8A).

Further in the image forming apparatus 10 according to the second comparative example, when the number of rotations of the photoconductor 102 is between 666K and 1000K rotations, an uneven potential occurs on the photoconductor 102 and thus the formed image has uneven density with acceptable image quality. Since the angle θ remains at 92 (Refer to FIG. 4B) during electrostatic charging on the photoconductor 102, a certain portion of the photoconductor 102 has shorter time to pass through the stable discharge region S1 as compared with the case of θ3 (Refer to FIGS. 4C and 8B). Further, the film 106 has a thickness between 12 μm and 17 μm i.e. relatively-thin and thus is not subjected to enough electric charge to be subjected stable electrostatic charging.

FIG. 12 is a diagram illustrating the observations of images formed in an image forming apparatus 10 according to a third comparative example for occurrence of a fine black line and occurrence of an uneven potential as the electrostatic charging apparatus 200 of the image forming apparatus 10 charges the photoconductor 102. The observations describe the formed image in each the number of rotations since starting use of the photoconductor 102. In the contrast to the change of the angle θ in response to the number of rotations of the photoconductor 102 in the above image forming apparatus 10 according to the first exemplary embodiment, the image forming apparatus 10 according to the third comparative example keeps the angle θ at θ3 (Refer to FIG. 8B) regardless of the number of rotations of the photoconductor 102. The image forming apparatus 10 according to the third comparative example has the same configuration as the image forming apparatus 10 according to the first exemplary embodiment except that the angle θ remains at θ3.

Items in the first to fifth columns of FIG. 12 are the same as FIG. 9, respectively. Further, a cross in the fourth column illustrating whether or not a fine black line occurs on a formed image means that a fine black line occurs on the image and the degree of the fine black line is a problematic image quality. Furthermore, double-crosses in the fourth column means that a fine black line occurs on an image and the degree of the fine black line is a serious problematic image quality.

In the image forming apparatus 10 according to the third comparative example, when the number of rotations of the photoconductor 102 is up to 333K rotations, a fine black line occurs on an image and the degree of the fine black line is within a serious problem of an image quality. Since the angle θ remains at 83 (Refer to FIG. 8B) during electrostatic charging on the photoconductor 102, a certain portion of the photoconductor 102 has longer time to pass through the unstable discharge region S2 as compared with the case of θ1 (Refer to FIG. 8A).

In the image forming apparatus 10 according to the third comparative example, when the number of rotations of the photoconductor 102 is between 333K and 666K rotations, a fine black line occurs on an image and the degree of the fine black line is problematic for image quality. Since the angle θ remains at 83 (Refer to FIGS. 8B and 4C) during electrostatic charging the photoconductor 102, a certain portion of the photoconductor 102 has longer time to pass through the unstable discharge region S2 as compared with the case of θ2 (Refer to FIGS. 4B).

Figure 13:
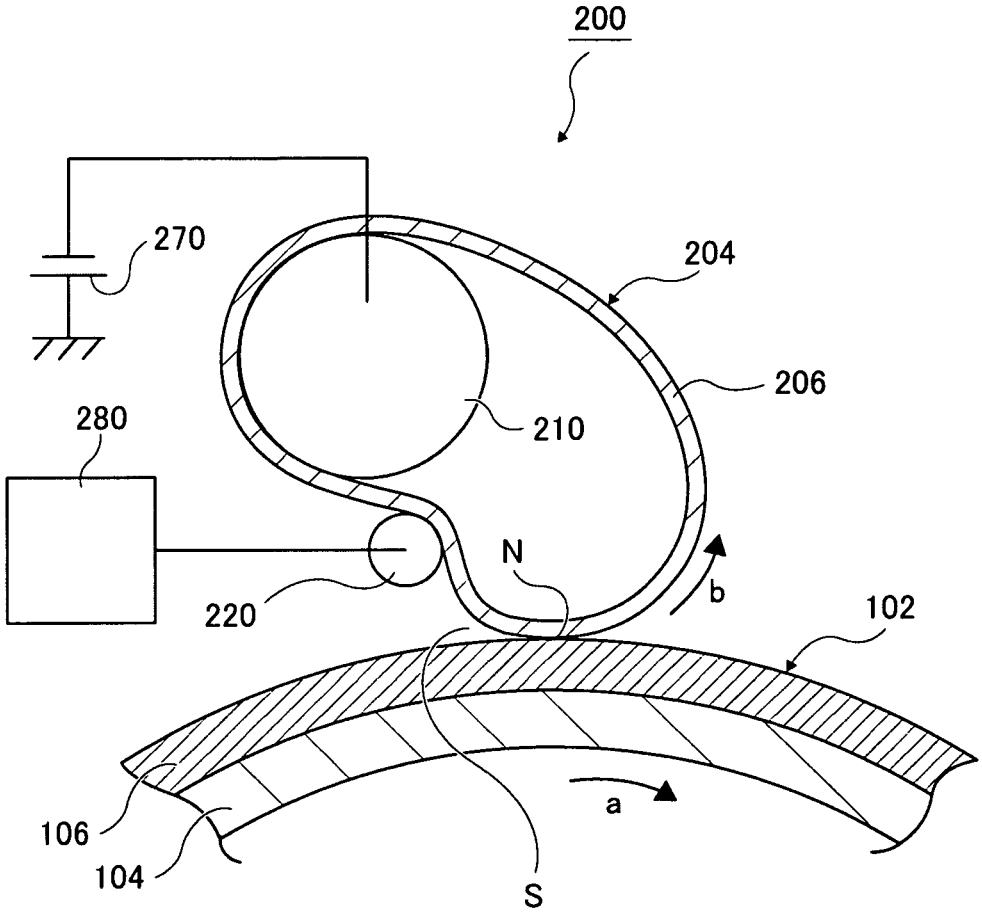
FIG. 13 is a view illustrating an electrostatic charging apparatus provided in an image forming apparatus according to a second exemplary embodiment of the present invention.

FIG. 13 illustrates an electrostatic charging apparatus 200 in an image forming apparatus 10 according to a second exemplary embodiment of the present invention. The above electrostatic charging apparatus 200 according to the first exemplary embodiment of the present invention has the endless-shaped electrostatic charging member 204 and the support 210 to support the electrostatic charging member 204 with being arranged inside the electrostatic charging member. The adjusting mechanism 280 attaches to the support 210 and allows the support 210 to move, and thereby the angle θ between the photoconductor 102 and the outer periphery 206 of the electrostatic charging member 204 in the wedge-shaped region changes. However, the electrostatic charging apparatus 200 of the image forming apparatus 10 according to the first modified example has the electrostatic charging member 204, the support 210, and further a contact member 220.

The contact member 220 is in contact with the outer periphery 206 of the electrostatic charging member 204 from the photoconductor 102 side. The contact member 220 has the adjusting mechanism 280 to adjust the angle θ by moving the contact member 220.

In the second exemplary embodiment of the present invention, the electrostatic charging member 204 is employed in belt-like form, that is, the electrostatic charging member 204 is not necessarily endless-shaped, and thus may be belt-like.

Except the above description, the image forming apparatus 10 according to the second exemplary embodiment has the same configuration as the image forming apparatus 10 according to the first exemplary embodiment.

FIG. 14 illustrates the operation of the electrostatic charging apparatus 200 in the image forming apparatus 10 according to the second exemplary embodiment. In the above electrostatic charging apparatus 200 according to the first exemplary embodiment, the adjusting mechanism 280 adjusts the angle θ between the photoconductor 280 and the outer periphery 206 of the electrostatic charging member 204 near the contact position N in the wedge-shaped region S by moving the support 210. However, in the electrostatic charging apparatus 200 according to the second exemplary embodiment, the adjusting mechanism 280 adjusts the angle θ by moving the contact member 220.

Figure 14C:
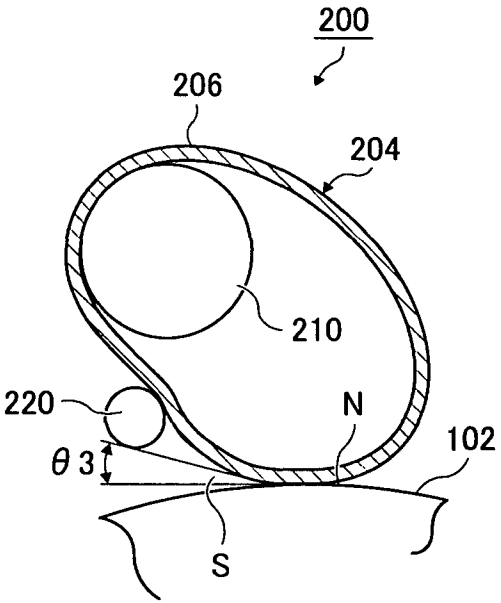
FIGS. 14A, 14B and 14C are views of the electrostatic charging apparatus shown in FIG. 13.
Figure 14B:
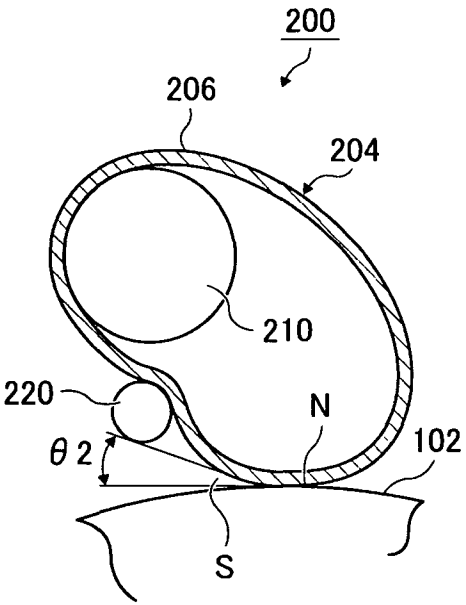
Figure 14A:
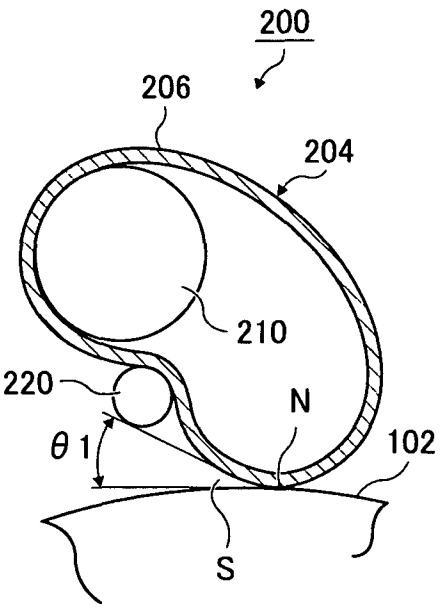

FIG. 14A illustrates the electrostatic charging apparatus 200 in which the contact member 220 and the electrostatic charging member 204 is in the first position and the angle θ is θ1. FIG. 14B illustrates the electrostatic charging apparatus 200 in which the contact member 220 and the electrostatic charging member 204 is in the second position and the angle θ is θ2. FIG. 14C illustrates the electrostatic charging apparatus 200 in which the contact member 220 and the electrostatic charging member 204 is in the third position and the angle θ is θ3.

Figure 15:
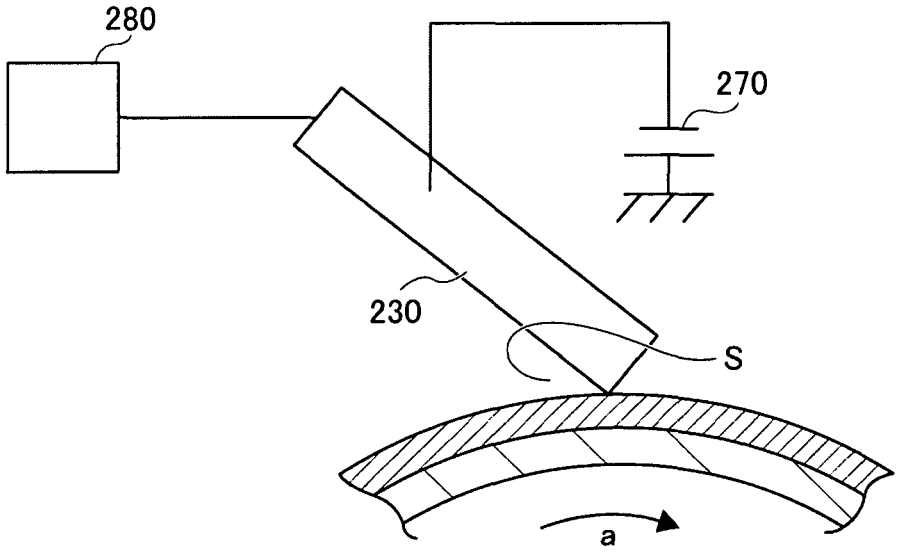
FIG. 15 is a view illustrating an electrostatic charging apparatus provided in an image forming apparatus according to a third exemplary embodiment of the present invention.

FIG. 15 illustrates an electrostatic charging apparatus 200 provided in the image forming apparatus 10 according to the third exemplary embodiment of the present invention. The above electrostatic charging apparatus 200 in the first exemplary embodiment of the present invention has the endless-shaped electrostatic charging member 204. However, in the third exemplary embodiment, the electrostatic charging apparatus 200 has a plate-like electrostatic charging member 230 attached with the adjusting mechanism 280. Except the above description, the image forming apparatus 10 according to the third exemplary embodiment has the same configuration as the image forming apparatus 10 according to the above first exemplary embodiment.

FIG. 16 illustrates the operation of the electrostatic charging apparatus 200 in the image forming apparatus 10 according to the third exemplary embodiment. In the above electrostatic charging apparatus 200 according to the first exemplary embodiment, the adjusting mechanism 280 adjusts the angle θ between the photoconductor 280 and the outer periphery 206 of the electrostatic charging member 204 near the contact position N in the wedge-shaped region S by moving the support 210. However, in the electrostatic charging apparatus 200 according to the third exemplary embodiment, the adjusting mechanism 280 adjusts the angle θ by moving the electrostatic charging member 230.

Figure 16A:
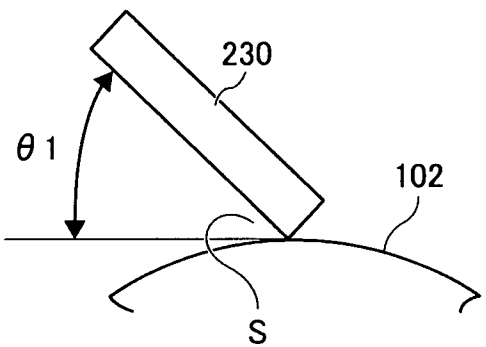
FIGS. 16A, 16B and 16C are views the illustrating electrostatic charging apparatuses shown in FIG. 15.
Figure 16B:
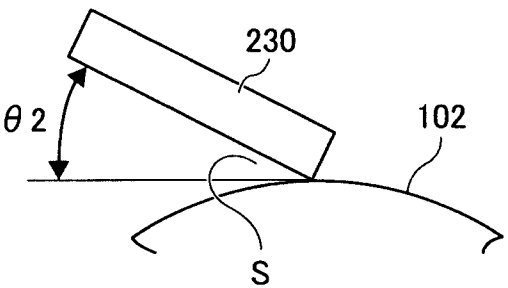
Figure 16C:
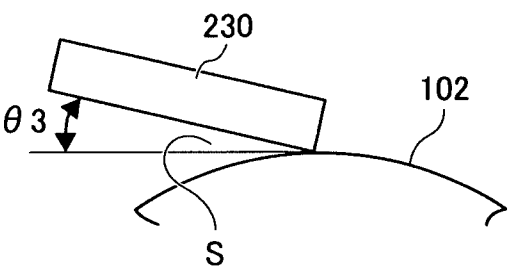

FIG. 16A illustrates the electrostatic charging apparatus 200 in which the electrostatic charging member 230 is in the first position and the angle θ is θ1. FIG. 16B illustrates the electrostatic charging apparatus 200 in which the electrostatic charging member 230 is in the second position and the angle θ is θ2. FIG. 16C illustrates the electrostatic charging apparatus 200 in which the electrostatic charging member 230 is in the third position and the angle θ is θ3.

In each of the exemplary embodiments described above, although described the angle θ regarding the three types, the angle θ may be changed to e.g. two types or more than four types in response to the number of rotations of electrostatic charging apparatus 200 or in response to the number of image formations of the image forming unit 100.

In each of the exemplary embodiments described above, the image forming unit 100 used for forming a single color image is described as one example. However each of the exemplary embodiments of the present invention may be applied to a multiple colors image forming apparatus as the image forming unit 100. For example, the present invention may be applied to an image forming apparatus to form an image using developers with colors of yellow, magenta, cyan and black and rotating a photoconductor four times. In this case, approximate quarter of the number of rotations of the photoconductor represents the number of image formations in the image forming apparatus.

As described above, the present invention is available for an image forming apparatus such as a printer and a fax machine, an image forming method using the image forming apparatus, an electrostatic charging apparatus applicable to e.g. the above image forming apparatus, and an electrostatic charging method using the electrostatic charging apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charging apparatus comprising:

an electrostatic charging member that has a discharge face causing discharge between the electrostatic charging member and a to-be-charged member having a charge retention part to hold a charge, and comes in contact with the to-be-charged member so as to charge upon the application of voltage;

an adjusting unit that adjusts an angle between the to-be-charged member and the discharge face; and a control unit that controls the adjusting unit so as to reduce the angle between the to-be-charged member and the discharge face in response to increasing the number of times of electrostatic charging.

2. An image formed apparatus comprising:

the electrostatic charging apparatus according to claim 1.

3. An electrostatic charging apparatus comprising:

an electrostatic charging member that has a discharge face causing discharge between the electrostatic charging member and a to-be-charged member having a charge retention part to hold a charge, and comes in contact with the to-be-charged member so as to charge upon the application of voltage; and an adjusting unit that adjusts an angle between the to-be-charged member and the discharge face;

wherein the electrostatic charging member is flexible and endless-shaped; and the adjusting unit is arranged inside the electrostatic charging member, has a support to support the electrostatic charging member, and adjusts the angle between the to-be-charged member and the discharge face by moving the support.

4. An image formed apparatus comprising:

the electrostatic charging apparatus according to claim 3.

5. An electrostatic charging member that has a discharge face causing discharge between the electrostatic charging member and a to-be-charged member having a charge retention part to hold a charge, and comes in contact with the to-be-charged member so as to charge upon the application of voltage; and an adjusting unit that adjusts an angle between the to-be-charged member and the discharge face;

wherein the electrostatic charging member is belt-like; and the adjusting unit has a contact member to come in contact with the electrostatic charging member from the to-be-charged member side and adjusts the angle between the to-be-charged member and the discharge face by moving the contact member.

6. An image formed apparatus comprising:

the electrostatic charging apparatus according to claim 5.

7. An electrostatic charging member that has a discharge face causing discharge between the electrostatic charging member and a to-be-charged member having a charge retention part to hold a charge, and comes in contact with the to-be-charged member so as to charge upon the application of voltage; and an adjusting unit that adjusts an angle between the to-be-charged member and the discharge face;

wherein the electrostatic charging member is plate-like.

8. An image formed apparatus comprising:

the electrostatic charging apparatus according to claim 7.

* * * * *